United States Patent [19]

Uytterhoeven et al.

[11] Patent Number: 4,639,404

[45] Date of Patent: Jan. 27, 1987

[54] LIQUID DEVELOPER FOR DEVELOPMENT OF ELECTROSTATIC IMAGES

[75] Inventors: Herman J. Uytterhoeven, Bonheiden; Walter F. De Winter, 's-Gravenwezel; August M. Mariën, Oevel, all of Belgium

[73] Assignee: Agfa-Gevaert, N.V., Mortsel, Belgium

[21] Appl. No.: 780,584

[22] Filed: Sep. 26, 1985

[30] Foreign Application Priority Data

Oct. 2, 1984 [EP] European Pat. Off. ..... 84201398

[51] Int. Cl.[4] ..... G03G 9/12

[52] U.S. Cl. ..... 430/115

[58] Field of Search ..... 430/114, 115

[56] References Cited

U.S. PATENT DOCUMENTS 4,564,574 1/1986 Utterhoeven et al. ..... 430/115

*Primary Examiner*—John D. Welsh

*Attorney, Agent, or Firm*—A. W. Breiner

[57] ABSTRACT

A liquid developer composition that is suitable for rendering visible electrostatically charged areas, which composition contains in an electrically insulating non-polar carrier liquid having a volume resistivity of at least $10^9$ ohm.cm and a dielectric constant less than 3, dispersed coloring matter acting as toner particles and at least one anionic addition polymer comprising anionic groups neutralized with non-polymeric counter cations, characterized in that said cations are positively charged metal ion containing coordination compounds.

10 Claims, No Drawings

LIQUID DEVELOPER FOR DEVELOPMENT OF ELECTROSTATIC IMAGES

The present invention relates to a liquid developer for development of electrostatic images.

Known electrophotographic processes comprise the steps of electrostatically charging in the dark a photoconductive surface, image-wise exposing said surface whereby the irradiated areas become discharged in accordance with the intensity of radiation thus forming a latent electrostatic image, and developing the material to form a visible image by depositing on the image a finely divided electroscopic material known as "toner". The toner particles consist of or include colouring substances e.g. carbon black. The thus developed image may be fixed to the surface carrying the electrostatic charge image or transferred to another surface and fixed thereon.

A process of developing an electrostatic image by use of an electrically insulating liquid developer, which contains dispersed particles of colouring substance called toner particles, that render the charge pattern visible through the phenomenon of electrophoresis, has been described already e.g. in the U.S. Pat. No. 2,907,674 of Kenneth Archibald Metcalfe and Robert John Wright issued Oct. 6, 1959.

In electrophoretic development a distinction is made between developers having dispersed toner particles which possess a positive charge and those which possess a negative charge. The charge value and the polarity of the toner particles are influenced by means of one or more so-called charge control agents.

In order to fix the toner particles at the places where they are deposited electrostatically, each particle comprises a resin coating, which may also play the role of dispersing agent and may serve also as charge control agent when containing ionic or ionizable groups.

Charging of the dispersed particles may proceed according to one method by a chemical compound that provides a charge from a chemical dissociation reaction on the toner particle surface and the introduction of a counter-ion in the electrically insulating carrier liquid (ref. Electrophotography—A Review by R. B. Comizolli et al., Proc. of the IEEE, Vol. 60. No. 4 April 1972, p. 363).

It is an object of the present invention to provide an electrophoretic liquid developer containing toner particles with particularly stable particle charge in time.

Other objects and advantages of the present invention will be clear from the further description.

According to the present invention a liquid developer composition is provided that is suitable for rendering visible electrostatically charged areas, which composition contains in an electrically insulating non-polar carrier liquid having a volume resistivity of at least $10^9$ ohm.cm and a dielectric constant less than 3, dispersed colouring matter acting as toner particles and at least one anionic addition polymer comprising anionic groups neutralized with non-polymeric counter cations, characterized in that said cations are positively charged metal ion containing coordination compounds.

The metal ion (A) is the central or nuclear ion, and all other atoms or groups which are directly attached to (A) are known as coordinating atoms or groups (B). These atoms or groups (B) are called ligands.

A chemical system containing more than one coordinating atom or group is called a multidentate coordination system. According to the number of coordinating atoms or groups the compounds are: unidentate, bidentate, tridentate, tetradentate, pentadentate, sexadentate compounds, etc.

The whole assembly of one or more central metal ions with their attached ligands is called a complex ion.

An organic or inorganic molecule or ion (called a ligand) that coordinates a metal ion in more than one position, i.e. through two or more electron donor groups in the ligand is by definition a chelating agent. The development of chelating agents has occurred primarily in the field of organic ligands, because it has been possible to synthesize organic ligands with many functional donor groups in different steric arrangements; thus high stability. Particularly useful chelating agents are these that coordinate metal ions through oxygen, sulphur or nitrogen donor atoms, or a combination of them.

In general, metal ions may be classified into several groups, depending on their coordination tendencies. The more basic metal ions, such as the alkaline earth metals, rare earth metals, and positive actinide ions have greater affinity for oxygen than for nitrogen (ref. Kirk-Othmer-Encyclopedia of Chemical Technology, second ed. Vol. 6 (1965) p. 1-7).

The use of a positively charged metal ion containing coordination compound as a counter cation to an anionic polymer chain, whether it be a homopolymer, copolymer (statistical), block copolymer or graft copolymer chain, results in the cations being rather loosely bound to the polymer chain due to the size of the effective radius of the positively charged coordination compound through its ligand(s). In consequence, only a weak electric field strength is present at the periphery of the cation and the dissociation of the ion pair composed of said cationic compound and anionic polymer chain is larger than it would otherwise be.

Since the carrier liquids used in electrophoretic development have a small dielectric constant (less than 3) there is little dissociation of the ion-pairs therein by mere polarisation. However, a large inter-ion distance by sterical hindrance results from the use of coordination compounds as defined herein, thus enabling ion-pair breaking by normal thermal energy in the carrier liquid.

Examples of useful positively charged metal ion containing coordination compounds are:

(1) unidentate compounds with $Me^+$ (Me=metal);

(2) bidentate compounds with central $Me^+$, $Me^{2+}$, $Me^{3+}$ or $Me^{4+}$ ion;

(3) tridentate compounds with central $Me^+$, $Me^{2+}$, $Me^{3+}$ or $Me^{4+}$ ion, (4) coordination compounds containing a polyethylene oxide chain, e.g. glyme-compounds (polyglycol dimethyl ether compounds) with central metal ion, (5) crown-ether compounds (macromonocyclic polyether compounds) with central metal ion, (6) cryptate compounds (macrobicyclic polyether compounds) with central metal ion, (7) quadridentate compounds with central $Me^+$, $Me^{2+}$, $Me^{3+}$ or $Me^{4+}$ ion, and (8) sextadentate compounds with central $Me^+$, $Me^{2+}$, $Me^{3+}$ or $Me^{4+}$ ion.

A survey of chelating agents and metal chelates is given by F. P. Dwyer and D. P. Mellor in the book "Chelating agents and Metal Chelates"—Academic Press—New York—London (1964), and by Colin F.

Bell in the book "Principles and applications of metal chelation" Clarendon Press-Oxford—1977.

Examples of particularly suitable non-polymeric complex ions and complexing agents are:

unidentates such as trialkyl- or triarylphosphines with $Cu^+$, e.g. as described in U.S. Pat. No. 859,092;

bidentates with central $Me^{2+}$, $Me^{3+}$ or $Me^{4+}$ ion such as:

(1) bis(acetylacetonato) Cu(II) chelate as represented by the formula:

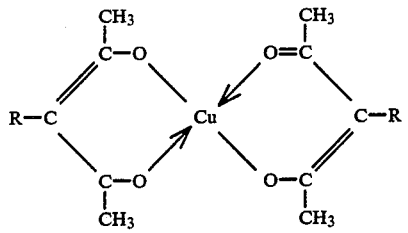

wherein: R represents hydrogen, or a hydrocarbon group, e.g. alkyl, aralkyl or aryl;

(2) metal chelates formed with organic amines, e.g. organic diamines. Specific examples of bidentate complexing agents are: ethylene diamine complexes or N-substituted ethylene diamine complexes, more particularly N-alkylethylene diamine complexes, 2,2'-bipyridyl complexes and 1,10-phenanthroline complexes;

tridentates with central $Me^{2+}$, $Me^{3+}$ or $Me^{4+}$ ion e.g. derived from organic amines, e.g. organic triamines. Specific examples of tridentate complexing agents are:

(1) diethylenetriamine (2) $\alpha$, $\beta$, $\gamma$-triaminopropane (3) 2,6-bis($\alpha$-pyridyl)pyridine(terpyridine)

(4) 4,4'-bis-(dimethylamino)thiobenzophenone complexing compounds containing polyethylene oxide unit(s), e.g.:

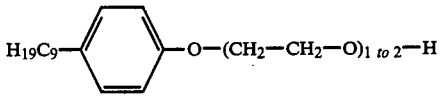

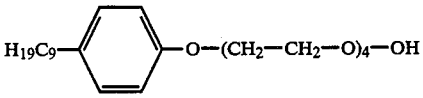

and $CH_3—O—CH_2—CH_2—O—CH_3$ glymes complexing $Na^+$ or $K^+$ such as:

pentaethylene glycol dimethylether also called "glyme-6" represented by the formula:

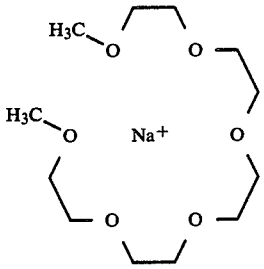

and, crown-ethers complexing $Na^+$ or $K^+$ such as:

(1)

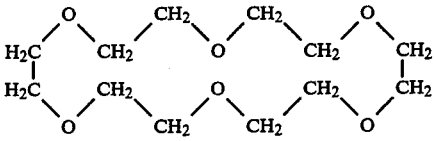

and, (2)

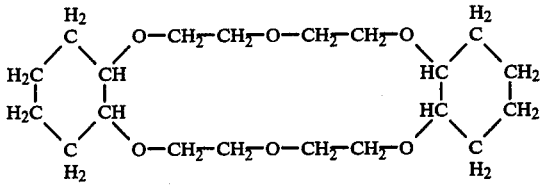

(3) benzo-18-crown-6represented by the formula:

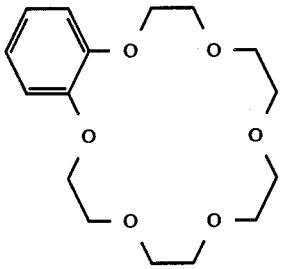

cryptates complexing $Na^+$ or $K^+$: 5,6-benzo-4,7,13,16,21,24-hexaoxa-1,10-diazabicyclo[8.8.8]hexacos-2-ene being, represented by the following structural formula:

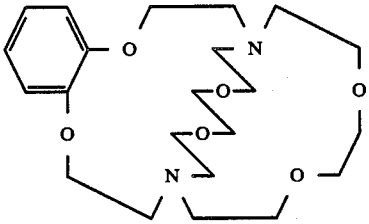

hexamethylphosphoric triamide in complexed form e.g. with $Cu^{2+}$.

quadridentates with central $Me^{2+}$, $Me^{3+}$ or $Me^{4+}$ ion derived e.g. from organic amines, e.g. tetra-amines. Specific quadridentate complexing agents are:

(1) triethylenetetramine having the structural formula:

$$NH_2—CH_2—CH_2—NH—CH_2—CH_2—NH—CH_2—CH_2—NH_2,$$

(2) $\beta,\beta',\beta'''$-triaminotriethylamine having the structural formula:

$$N(CH_2—CH_2—NH_2)_3,$$

(3) 1,8-bis($\alpha$-pyridyl)3,6-dithiaoctane having the structural formula:

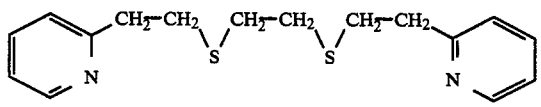

(4) a phthalocyanine, e.g. a hydroxylaluminiumphthalocyanine that has reacted with the anionic (e.g. acidic) addition polymer. The use of hydroxylaluminiumphthalocyanine for the preparation of cyan pigments is described in U.S. Pat. No. 4,311,775 in connection with the production of electrophoretic colour developers.

sextadentates with central $Me^{+}$, $Me^{3+}$ or $Me^{4+}$ ion e.g. a non-planar sextadentate derived from 1,8-bis(-salicylideneamino)-3,6-dithiaoctane having the structural formula:

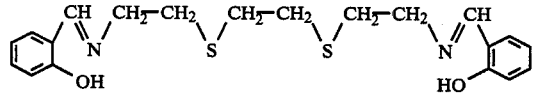

Anionic polymers for use according to the present invention may be prepared by addition polymerisation of the corresponding monomer(s) with counter metal cations that are complexed with the elected complexing or chelating agent.

The anionic polymers for use according to the present invention may be homopolymers or copolymers.

When preparing a copolymer containing recurring anionic units, these units may be distributed at random in the polymer chain with other, e.g. hydrophobic monomer units. The copolymer may likewise be a block- or graft copolymer containing groups or blocks of said monomer units.

Suitable anionic monomers for the preparation of said anionic addition polymers are exemplified hereinafter by general formula:

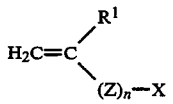

wherein:

$R^1$ represents hydrogen or lower ($C_1$–$C_3$) alkyl, e.g. methyl,

Z represents a bivalent organic group, e.g. a bivalent hydrocarbon group such as an alkylene group or an arylene group or represents a bivalent hydrocarbon group interrupted by one or more hetero-atoms, e.g. nitrogen and/or oxygen, or said group interrupted by a —CO—O— group or represents a —CONH-alkylene-group.

n represents zero or 1, and

X represents $—COO^-$, $—SO_3^-$, $—SO_4^-$, $—PO_4H_2^-$ or $—PO_4HR^-$, wherein R represents a hydrocarbon group, e.g. an alkyl group.

In the polymers for use according to the present invention the recurring units associated with said positively charged metal ion containing coordination compounds may be combined with recurring units of non-ionic hydrophobic, solvatable and/or non-solvatable monomers.

Optionally used non-ionic hydrophobic solvatable monomers are listed hereinafter in List I.

List I alkylstyrenes having from 3 to 10 carbon atoms in the alkyl group, alkoxystyrenes having from 3 to 10 carbon atoms in the alkyl group, alkyl acrylates and methacrylates having from 8 to 22 carbon atoms in the alkyl group, vinyl alkyl ethers having from 8 to 22 carbon atoms in the alkyl group, vinyl esters of alkanoic acids having from 6 to 22 carbon atoms in the alkyl group.

Preferred non-ionic hydrophobic solvatable monomers are: lauryl acrylate, lauryl methacrylate, hexadecyl methacrylate, octadecyl methacrylate, vinyl laurate, vinyl palmitate, vinyl stearate, vinyl eicosate and vinyl docosate.

The non-ionic hydrophobic solvatable monomer units may be used in admixture with substantially non-solvatable non-ionic monomer units. Examples of such non-ionic non-solvatable monomers are enumerated in List II.

List II (a) $\alpha,\beta$-ethylenically unsaturated carboxylic acid alkyl esters with a $C_1$–$C_4$ alkyl group, (b) styrene, methylstyrene, methoxystyrene and halogenated styrene, (c) vinyl alkyl ethers having from 1 to 4 carbon atoms in the alkyl group, and (d) vinyl esters of alkanoic acids having from 1 to about 4 carbon atoms in the alkyl groups and mixtures thereof.

Examples of non-ionic "non-solvatable" monomers increasing the adsoption to the pigment particles are: styrene, vinyltoluene, ethyl acrylate, propyl methacrylate, isobutyl methacrylate, vinyl acetate, vinyl propionate, vinyl butyrate and mixtures thereof.

A particularly useful group of anionic copolymers for the preparation of liquid toners according to the present invention contains from 10 to 88.5 percent by weight of non-ionic solvatable monomer units, from 10 to 80 percent by weight of non-solvatable monomer units and from 1.5 to 50 percent by weight of anionic recurring groups in association with said cations that are positively charged metal ion containing coordination compounds.

For a still better dispersing capability of the toner particles the homopolymer or copolymer containing said anionic recurring units may be used in conjunction with non-ionic copolymers of the type disclosed in GB-P 1,572,343 and block-copolymers disclosed in U.S. Pat. No. 4,522,908.

The percent by weight of anionic polymer with respect to the colouring matter (e.g. carbon black) of the liquid developer is preferably in the range of 2 to 50.

In order to illustrate in detail the preparation of polymers containing anionic recurring units associated with complexable metal ions the following preparations are given.

Preparation 1

Copolymer A having the following structural formula:

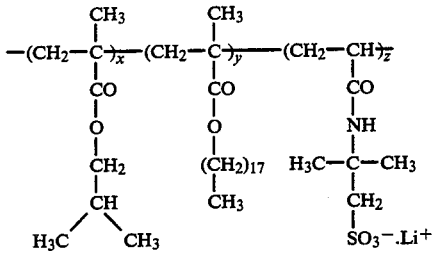

was prepared as follows:

A solution of 70 g of isobutyl methacrylate, 20 g of stearyl methacrylate, 10 g of 2-acrylamido-2-methylpropane sulphonic acid, 200 mg of azo-bis-isobutyronitrile in 400 ml of dimethylformamide was freed of oxygen of the air by bubbling-through nitrogen. The copolymerization was carried out for 24 h at 70° C. keeping the reaction mixture under a constant stream of nitrogen. After cooling to 20° C. the copolymer was separated by precipitation in water. The copolymer was washed thoroughly with water and dried at 20° C. under diminished pressure.

10 g of the free sulphonic acid copolymer was dissolved in methanol and with stirring the pH of the solution was raised to 7 by introducing a 0.1N solution of lithium hydroxide in methanol. The solvent was removed by evaporation and the copolymer after dissolving in water was freeze-dried.

Preparation 2

Copolymer B having the following structural formula:

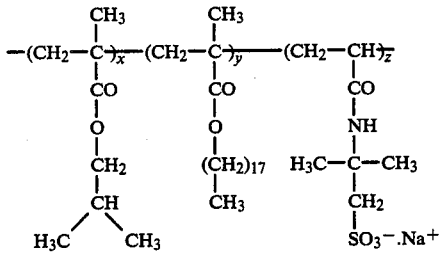

was prepared by repeating the procedure of preparation 1 with the proviso that the sulphonic acid copolymre was neutralized with sodium hydroxide instead of with lithium hydroxide.

Preparation 3

Copolymer C having the following structural formula:

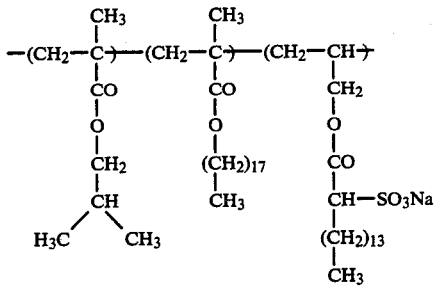

was prepared as follows:

A solution of 70 g of isobutyl methacrylate, 20 g of stearyl methacrylate, 10 g of α-sulphopalmitic acid allyl ester sodium salt and 200 mg of azo-bis-isobutyronitrile in 400 ml of dimethylformamide was freed of oxygen of the air by bubbling-through nitrogen. The copolymerization was carried out for 24 h at 70° C. keeping the reaction mixture constantly under a stream of nitrogen. After cooling to 20° C. the copolymer was separated by precipitation in methanol. After decanting the supernatant liquid the sticky polymer mass was washed several times with methanol till a hard, brittle product was obtained. The copolymer was dried under diminished pressure.

Preparation 4

Copolymer D having the following structural formula:

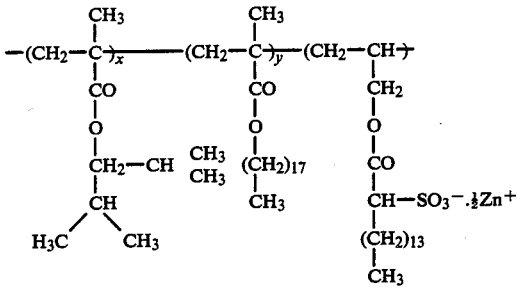

was prepared as follows:

A solution of 70 g of isobutyl methacrylate, 20 g of stearyl methacrylate, 10 g of α-sulphopalmitic acid allyl ester and 200 mg of azo-bis-isobutyronitrile in 400 ml of butanone was freed of oxygen of the air by bubbling-through nitrogen. The copolymerization was carried out at 70° C. keeping the reaction mixture constantly under a stream of nitrogen. After cooling to 20° C. the copolymer was separated by precipitation in methanol and was dried under diminished pressure.

To a solution of 25 g of said copolymer dissolved in 250 ml of acetone 10 g of zinc acetate was added and the reaction mixture was boiled with reflux for 2 h.

After cooling to 20° C. the copolymer was separated by precipitating in methanol and after thoroughly washing with methanol was dried under diminished pressure.

The insulating liquid used as carrier liquid in the present liquid developer may be any kind of non-polar, fat-dissolving solvent. Said liquid is preferably a hydrocarbon solvent e.g. an aliphatic hydrocarbon such as hexane, cyclohexane, iso-octane, heptane or isododecane, a fluorocarbon or a silicone oil. Thus, the insulating liquid is e.g. isododecane or a commercial petroleum distillate, e.g. a mixture of aliphatic hydrocarbons having a boiling range preferably between 150° C. and 220° C. such as the ISOPARS G, H, K and L (trade marks) of Exxon and SHELLSOL T (trade mark) of the Shell Oil Company.

The colouring substance used in the toner particles may be any inorganic pigment (said term including carbon) or solid organic dyestuff pigment commonly employed in liquid electrostatic toner compositions. Thus, for example, use can be made of carbon black and analogous forms thereof e.g. lamp black, channel black and furnace black e.g. RUSS PRINTEX 140 GEPERLT (trade-name of DEGUSSA-Frankfurt/M, W.Germany).

Typical solid organic dyestuffs are so-called pigment dyes, which include phthalocyanine dyes, e.g. copper phthalocyanines, metal-free phthalocyanine, azo dyes and metal complexes of azo dyes.

The following dyes in pigment form are given for illustration purposes only: FANALROSA B Supra Pulver (trade-name of Badische Anilin- & Soda-Fabrik AG, Ludwigshafen, Western Germany), HELIOGENBLAU LG (trade-name of BASF for a metal-free phthalocyanine blue pigment), MONASTRAL BLUE (a copper phthalocyanine pigment, C.I. 74,160). HELIOGENBLAU B Pulver (trade-name of BASF), HELIOECHTBLAU HG (trade-name of Bayer AG, Leverkusen, Western Germany, for a copper phthalocyanine C.I. 74,160), BRILLIANT CARMINE 6B (C.I. 18,850) and VIOLET FANAL R (trade-name of BASF, C.I. 42,535).

Typical inorganic pigments include black iron(III) oxide and mixed copper(II) oxide/chromium(III) oxide/iron(III) oxide powder, milori blue, ultramarine cobalt blue and barium permanganate. Further are mentioned the pigments described in the French Patent Specifications 1,394,061 filed Dec. 23, 1963 by Kodak Co., and 1,439,323 filed Apr. 24, 1965 by Harris Int. Corp.

Preferred carbon black pigments are marketed by DEGUSSA under the trade name PRINTEX. PRINTEX 140 and PRINTEX G are preferably used in the developer composition of the present invention. The characteristics of said carbon blacks are listed in the following Table 1.

TABLE 1

| | PRINTEX 140 | PRINTEX G |
|---|---|---|
| origin | channel black | furnace black |
| density | 1.8 g · cm$^{-3}$ | 1.8 g · cm$^{-3}$ |
| grain size before entering the developer | 29 nm | 51 nm |
| oil number (g of linseed oil adsorbed by 100 g of pigment) | 360 | 250 |
| specific surface (sq.m per g) | 96 | 31 |
| volatile material % by weight | 6 | 2 |
| pH | 5 | 8 |
| colour | brown-black | blue-black |

As colour corrector for the PRINTEX pigments preferably minor amounts of copper phthalocyanine are used, e.g. from 1 to 20 parts by weight with respect to the carbon black.

For a given charge density of the charge-carrying surface the maximum development density attainable with toner particles of a given size is determined by the charge/toner particle mass ratio, which is determined substantially by the amount and/or type of polymer employed.

A liquid developer composition according to the present invention can be prepared by using dispersing and mixing techniques well known in the art.

It is conventional to prepare by means of suitable mixers e.g. a 3-roll mill, ball mill, colloid mills, high speed stirrers, a concentrate of e.g. 5 to 80% by weight of the solid materials selected for the composition in the insulating carrier liquid and subsequently to add further insulating carrier liquid to provide the liquid toner composition ready for use in the electrostatic reproduction process. It is generally suitable for a ready-for-use electrophoretic liquid developer to incorporate the toner in an amount between 0.3 g and 20 g per liter, preferably between 2 g and 10 g per liter.

The (co)polymer(s) used in the present developer liquid can be applied as a pre-coating to the pigment particles prior to their introduction in the carrier liquid or can be introduced as a separate ingredient in the liquid and allowed to become adsorbed onto the pigment particles.

The electrophoretic development may be carried out using any known electrophoretic development technique or device. The field of the image to be developed may be influenced by the use of a development electrode. The use of a development electrode is of particular value in the development of continuous tone images. When no development electrode is used, the developed image may exhibit exaggerated density gradients, which may be of interest e.g. in certain medical X-ray images for diagnostic purposes.

The following examples illustrate the present invention.

EXAMPLES 1–4

1 g of copolymer A prepared according to preparation 1 was first dissolved in 50 ml of isododecane and to the solution twice the equivalent amount of a complexing agent as described in Table 2 was added thereto. In the obtained solution 4 g of PRINTEX G (trade name) carbon black pigment was dispersed.

The charge sign of the toner particles was determined by a test proceeding as follows:

"In an electrophoresis cell having two planar electrodes each with a surface of 20 cm2 spaced at a distance of 0.15 cm is filled with the above toner developer of which 4 ml were diluted with 1 liter of isododecane. The electric current (I) flowing between the two electrodes at a voltage pulse of 500 V for 0.5 s is measured."

The current (I) is the result of a charge (Q) transport due to the inherent conductivity of the liquid without toner and the electrophoretic toner particle displacement towards one of the electrodes. The toner-deposition (blackening) of the positive electrode (anode) proves that the toner particles are negatively charged. The $Q_T$ value is the charge value obtained by integrating the current I in amperes over the period (t) of 0.5 s ($I=Q/t$, so $I \times t$=charge Q) and is a measure for the charge Q in coulomb on the toner particles.

The charge stability of the toner particles was determined by measuring the $Q_{T1}$ value immediately after the developer preparation and $Q_{T2}$ 17 days thereafter upon redispersing optionally precipitated toner by stirring. A small difference in $Q_T$ value points to a high charge stability per toner particle i.e. a poor ion association and low particle agglomeration.

The average diameter of the toner particles was 250–300 nm measured with the COULTER (trade mark) NANO-SIZER. The measuring principles used in this instrument are those of Brownian motion and autocorrelation spectroscopy of scattered laser light. The frequency of this Brownian motion is inversely related to particle size.

TABLE 2

| Complexing agent |
|---|
| 1. 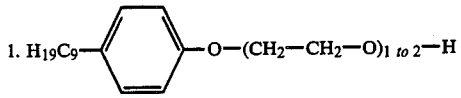 |
| 2. 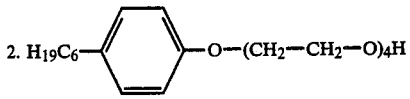 |
| 3. 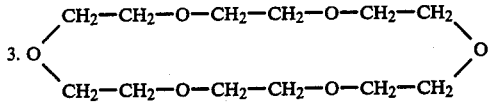 |
| 4. acetylacetone |

The $Q_{T1}$ and $Q_{T2}$ values obtained with the toner developers prepared with these complexing agents 1, 2, 3 and 4 respectively were the following (A), (B), (C) and (D).

(A)
$Q_{T1} = -12.10^{-8}C$
$Q_{T2} = -8.10^{-8}C$ (B)
$Q_{T1} = -7.5.10^{-8}C$
$Q_{T2} = -7.10^{-8}C$ (C)
$Q_{T1} = -6.10^{-8}C$
$Q_{T2} = -6.10^{-8}C$ (D)
$Q_{T1} = -16.5.10^{-8}C$
$Q_{T2} = -8.10^{-8}C$

EXAMPLE 5

In the present example it was not possible to dissolve the complexing agent in the carrier liquid, the colouring matter, here the carbon black PRINTEX G (trade name) was first coated with the complexing agent as described hereinafter from a solvent in a rotary evaporator.

To the thus treated carbon black 1 g of copolymer A dissolved in 50 ml of isododecane was added, the amount of complexing agent being twice the equivalent amount of the metal ions in the copolymer to be complexated.

The complexing agent applied that way corresponds to the following structural formula:

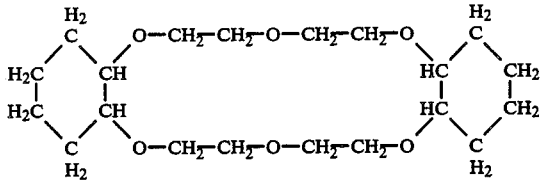

The $Q_{T1}$ and $Q_{T2}$ values as defined in Examples 1–4 were: $-6.10^{-8}C$ and $-6.10^{-8}C$.

The average diameter of the toner particles measured as defined in Examples 1–4 was about 300 nm.

EXAMPLES 6–8

1 g of copolymer C prepared according to preparation 3 was first dissolved in 50 ml of butanone and to the solution twice the equivalent amount of a complexing agent as described in Table 3 was added thereto. In the obtained solution 4 g of PRINTEX G (trade name) carbon black pigment was dispersed.

After dispersion the solvent was evaporated leaving the copolymer and the complexing agent coated onto the carbon black particles.

The copolymer-coated carbon black was then redispersed in 50 ml of isododecane by ball-milling for 15 h.

TABLE 3

| Complexing agent |
|---|
| 1. Tetramethylethylenediamine 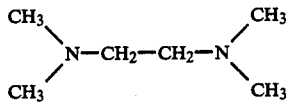 |
| 2. triphenylfosfine 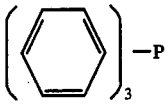 |
| 3. 4,4'-bis-(dimethylamino)thiobenzophenone 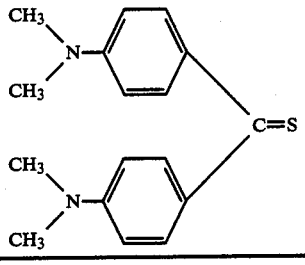 |

The $Q_{T1}$ and $Q_{T2}$ values obtained with the toner developers prepared with these complexing agents 1, 2 and 3 respectively were the following (A), (B) and (C).

(A)
$Q_{T1} = -7.10^{-8}C$
$Q_{T2} = -5.10^{-8}C$ (B)
$Q_{T1} = -11.10^{-8}C$
$Q_{T2} = -7.10^{-8}C$ (C)
$Q_{T1} = -4.10^{-8}C$
$Q_{T2} = -5.10^{-8}C$

The average diameter of the toner particles measured as defined in Examples 1–4 was in the range of 250–300 nm.

The obtained electrophoretic toner developers proved to be suited for the reversal development of negatively charged areas on commercial zinc oxide photoconductor recording material which was negatively charged to −500 V by corona discharge before image-wise exposure.

EXAMPLES 9–11

1 g of copolymer D prepared according to preparation 4 was first dissolved in 50 ml of butanone and to the solution twice the equivalent amount of a complexing agent as described in Table 3 was added thereto. In the obtained solution 4 g of PRINTEX G (trade name) carbon black pigment was dispersed.

After dispersion the solvent was evaporated leaving the copolymer and the complexing agent coated onto the carbon black particles.

The copolymer-coated carbon black was then redispersed in 50 ml of isododecane by ball-milling for 15 h.

The $Q_{T1}$ and $Q_{T2}$ values obtained with the toner developers prepared with these complexing agents 1,2 and 3 respectively were the following (A), (B) and (C).

(A)

$Q_{T1} = -13.10^{-8}C$ $Q_{T2} = -7.10^{-8}C$ (B)

$Q_{T1} = -11.10^{-8}C$ $Q_{T2} = -5.10^{-8}C$ (C)

$Q_{T1} = -4.10^{-8}C$ $Q_{T2} = -3.10^{-8}C$

The average diameter of the toner particles measured as defined in Examples 1–4 was in the range of 250–300 nm.

EXAMPLES 12 AND 13

4 g of commercial carbon black PRINTEX G (trade name) were first coated with the complexing agent hexamethylenetetramine by the process described in Example 5.

To the carbon black coated with the complexing agent 1 g of copolymer C or D in 50 ml of isododecane was added. The preparation of the toner dispersion proceeded by ball-milling for 15 h.

The $Q_{T1}$ and $Q_{T2}$ values of the thus prepared toner developers were defined as explained in Examples 1–4.

(1) with copolymer C $Q_{T1} = -5.10^{-8}C$ $Q_{T2} = -4.10^{-8}C$ (2) with copolymer D $Q_{T1} = -5.10^{-8}C$ $Q_{T2} = -4.10^{-8}C$ The average diameter of the toner particles measured as defined in Examples 1–4 was about 300 nm.

The obtained electrophoretic toner developers proved to be suited for the reversal development of negatively charged areas on commercial zinc oxide photoconductor recording material which was negatively charged to −500 V by corona discharge before image-wise exposure.

For improving the dispersing of the carbon black pigment in the preparation of the toner developers of the preceding Examples 1–13 block-copolymer No. 10 of Table 4 of U.S. Pat. No. 4,522,908 in a 10% by weight ratio with respect to the pigment was used.

We claim:

1. A liquid developer composition that is suitable for rendering visible electrostatically charged areas, which composition contains in an electrically insulating non-polar carrier liquid having a volume resistivity of at least $10^9$ ohm.cm and a dielectric constant less than 3, dispersed colouring matter acting as toner particles and at least one anionic addition polymer comprising anionic groups neutralized with non-polymeric counter cations, characterized in that said cations are positively charged metal ion containing coordination compounds.

2. Liquid developer composition according to claim 1, characterized in that the positively charged metal ion containing coordination compounds are selected from the group:

(1) unidentate compounds with $Me^+$ (me=metal);

(2) bidentate compounds with central $Me^+$, $Me^{2+}$, $Me^{3+}$ or $Me^{4+}$ ion;

(3) tridentate compounds with central $Me^+$, $Me^{2+}$, $Me^{3+}$ or $Me^{4+}$ ion, (4) coordination compounds containing a polyethylene oxide chain, (5) crown-ether compounds (macromonocyclic polyether compounds) with central metal ion, (6) cryptate compounds (macrobicyclic polyether compounds) with central metal ion, (7) quadridentate compounds with central $Me^+$, $Me^{2+}$, $Me^{3+}$ or $Me^{4+}$ ion, (8) sextadentate compounds with central $Me^+$, $Me^{2+}$, $Me^{3+}$ or $Me^{4+}$ ion.

3. Liquid developer composition according to claim 1, characterized in that the positively charged metal ion containing coordination compounds are glyme-compounds with central metal ion.

4. Liquid developer composition according to claim 1, characterized in that the positively charged metal ion containing coordination compound is formed with acetylacetone.

5. Liquid developer composition according to claim 1, characterized in that the positively charged metal ion containing coordination compound is formed with a diamine, tri-amine or tetra-amine.

6. Liquid developer composition according to claim 1, characterized in that the anionic polymers are prepared by polymerization of anionic monomers within the scope of the following general formula:

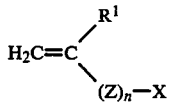

wherein:

$R^1$ represents hydrogen or lower ($C_1$–$C_3$)alkyl,

Z represents a bivalent hydrocarbon group or represents a bivalent hydrocarbon group interrupted by nitrogen and/or oxygen, or said group interrupted by —CO—O— or represents a —CONH-alkylene group, n represents zero or 1, and X represents $—COO^-$, $—SO_3^-$, $—SO_4^-$, $—PO_4H_2^-$ or $—PO_4HR^-$, wherein R represents a hydrocarbon group.

7. Liquid developer composition according to claim 6, characterized in that in said polymer the recurring units associated with said positively charged metal ion containing coordination compounds are combined with recurring units of non-ionic hydrophobic, solvatable and/or non-solvatable monomers.

8. Liquid developer composition according to claim 6, characterized in that the solvatable monomers are:

alkylstyrenes having from 3 to 10 carbon atoms in the alkyl group, alkoxystyrenes having from 3 to 10 carbon atoms in the alkyl group, alkyl acrylates and methacrylates having from 8 to 22 carbon atoms in the alkyl group, vinyl alkyl ethers having from 8 to 22 C-atoms in the alkyl group, vinyl esters of alkanoic acids having from 6 to 22 carbon atoms in the alkyl group.

9. Liquid developer composition according to claim 6, characterized in that the non-solvatable monomers are:

(a) $\alpha,\beta$-ethylenically unsaturated carboxylic acid alkyl esters with a $C_1$–$C_4$ alkyl group, (b) styrene, methylstyrene, methoxystyrene and halogenated styrene, (c) vinyl alkyl ethers having a C1 to C4-alkyl group, and (d) vinyl esters of alkanoic acids having from 1 to about 4 carbon atoms in the alkyl groups and mixtures thereof.

10. Liquid developer composition according to claim 6, characterized in that the percent by weight of anionic polymer with respect to the colouring matter of the liquid developer is in the range of 2 to 50.

* * * * *